US008356432B2

(12) United States Patent
Carpenter

(10) Patent No.: US 8,356,432 B2
(45) **Date of Patent: *Jan. 22, 2013**

(54) WEAR ASSEMBLY

(75) Inventor: Christopher M. Carpenter, Tualatin, OR (US)

(73) Assignee: ESCO Corporation, Portland, OR (US)

( * ) Notice: Subject to any disclaimer, the term of this patent is extended or adjusted under 35 U.S.C. 154(b) by 143 days.

This patent is subject to a terminal disclaimer.

(21) Appl. No.: 12/792,999

(22) Filed: Jun. 3, 2010

(65) Prior Publication Data

US 2011/0131843 A1 Jun. 9, 2011

Related U.S. Application Data

(63) Continuation of application No. 11/706,592, filed on Feb. 14, 2007, now Pat. No. 7,730,651.

(60) Provisional application No. 60/774,401, filed on Feb. 17, 2006.

(51) Int. Cl.
*E02F 9/28* (2006.01)

(52) U.S. Cl. ..... 37/452; 37/453; 37/455; 37/456

(58) Field of Classification Search ..... 37/446, 37/450, 452–456; 172/719

See application file for complete search history.

(56) References Cited

U.S. PATENT DOCUMENTS

| | | | | |
|---|---|---|---|---|
| 1,384,701 | A | | 7/1921 | McMonegal |
| 1,916,354 | A | | 7/1933 | Barber |
| 2,040,085 | A | | 3/1934 | Fykse et al. |
| 2,921,391 | A | | 1/1960 | Opsahl |
| 3,079,710 | A | | 3/1963 | Larsen et al. |
| 3,444,633 | A | | 5/1969 | Hensley |
| 3,624,827 | A | * | 11/1971 | Liess et al. ..... 37/92 |
| 3,675,350 | A | * | 7/1972 | Mulcahy et al. ..... 37/457 |
| 3,704,753 | A | | 12/1972 | Hasforth et al. |
| 3,881,262 | A | | 5/1975 | Cullen |
| 4,136,469 | A | | 1/1979 | Zepf |
| 4,404,760 | A | * | 9/1983 | Hahn et al. ..... 37/459 |
| 4,577,423 | A | | 3/1986 | Hahn |
| 5,144,762 | A | | 9/1992 | Robinson |
| 5,177,886 | A | | 1/1993 | Klett |
| 5,386,653 | A | | 2/1995 | Cornelius |
| 5,456,029 | A | | 10/1995 | Cornelius |
| 5,564,206 | A | | 10/1996 | Ruvang |
| 5,709,043 | A | | 1/1998 | Jones et al. |
| 5,765,301 | A | | 6/1998 | Clendenning |
| 5,778,571 | A | * | 7/1998 | Pasqualini et al. ..... 37/455 |
| D410,657 | S | | 6/1999 | Launder |
| 5,956,874 | A | | 9/1999 | Ianello et al. |
| 5,987,787 | A | | 11/1999 | Mack |
| 6,047,487 | A | | 4/2000 | Clendenning |
| 6,079,132 | A | | 6/2000 | Clendenning |
| 6,108,950 | A | | 8/2000 | Ruvang et al. |
| 6,247,255 | B1 | | 6/2001 | Clendenning |
| 6,321,471 | B2 | | 11/2001 | Fernandez Munoz et al. |
| 6,735,890 | B2 | | 5/2004 | Carpenter et al. |
| 6,865,828 | B1 | | 3/2005 | Molino et al. |
| 2001/0001352 | A1 | | 5/2001 | Fernandez Munoz et al. |

FOREIGN PATENT DOCUMENTS

| | | | |
|---|---|---|---|
| JP | 410183698 | A | 7/1998 |

* cited by examiner

*Primary Examiner* — Thomas B Will
*Assistant Examiner* — Mai Nguyen
(74) *Attorney, Agent, or Firm* — Steven P. Schad

(57) ABSTRACT

A wear assembly for securing a wear member to excavating equipment that includes a base having a nose and a wear member having a socket. The nose and socket are each provided with one or more complementary stabilizing surfaces in central portions thereof.

13 Claims, 9 Drawing Sheets

WEAR ASSEMBLY

This application is a continuation of application Ser. No. 11/706,592 filed Feb. 14, 2007, now U.S. Pat. No. 7,730,651, which is a non-provisional application based on provisional patent application Ser. No. 60/774,401, filed Feb. 17, 2006.

FIELD OF THE INVENTION

The present invention pertains to a wear assembly for securing a wear member to excavating equipment.

BACKGROUND OF THE INVENTION

Wear parts are commonly attached along the front edge of excavating equipment, such as excavating buckets or cutterheads, to protect the equipment from wear and to enhance the digging operation. The wear parts may include excavating teeth, shrouds, etc. Such wear parts typically include a base, a wear member and a lock to releasably hold the wear member to the base.

In regard to excavating teeth, the base includes a nose which is fixed to the front edge of the excavating equipment (e.g., a lip of a bucket). The nose may be formed as an integral part of the front edge or as part of one or more adapters that are fixed to the front edge by welding or mechanical attachment. A point is fit over the nose. The point narrows to a front digging edge for penetrating and breaking up the ground. The assembled nose and point cooperatively define an opening into which the lock is received to releasably hold the point to the nose.

These kinds of wear parts are commonly subjected to harsh conditions and heavy loading. Accordingly, the wear members wear out over a period of time and need to be replaced. Many designs have been developed in an effort to enhance the strength, stability, durability, penetration, safety, and ease of replacement of such wear members with varying degrees of success.

SUMMARY OF THE INVENTION

The present invention pertains to an improved wear assembly for securing wear members to excavating equipment for enhanced stability, strength, durability, penetration, safety, and ease of replacement.

In accordance with one aspect of the invention, the base and wear member define a nose and socket, which are formed with complementary stabilizing surfaces extending substantially parallel to the longitudinal axis of the assembly to provide a stronger and more stable construction. One or more of the stabilizing surfaces are formed generally along central portions of the nose and socket, and away from the outer edges of these components. As a result, the high loads anticipated during use are primarily carried by the more robust portion of the nose, and not on the extreme bending fibers, for a stronger and longer lasting base structure. This construction further reduces the formation of high stress concentrations along the components.

In another aspect of the invention, the wear member includes a socket opening in the rear end to receive a supporting nose. The socket is defined by top, bottom and side walls and has a longitudinal axis. At least one of the top and bottom walls includes a stabilizing projection, each of which has bearing surfaces facing in different directions to bear against opposite sides of a V-shaped recess in the nose.

In another aspect of the invention, pairs of stabilizing surfaces in each component are formed at a transverse angle to each other to provide enhanced stability in resisting vertical and side loads. In one exemplary embodiment, the stabilizing surfaces form a V-shaped configuration on at least one side of the nose and the socket.

In one other aspect of invention, the stabilizing surfaces are recessed in the nose to protect these base surfaces from damage and wear caused by the mounting of successive wear members or due to excessive wearing of the wear members.

In another aspect of the invention, the nose and socket are formed with complementary recesses and projections on all sides (i.e., top, bottom and side walls) in order to maximize the stabilizing surfaces available to resist the heavy loads that can occur during use.

In another aspect of the invention, the nose and socket are each formed to have a generally X-shaped, transverse, cross-section for enhanced stability. While the recesses and projections forming these configurations are preferably defined by stabilizing surfaces, benefits can still be achieved with the use of bearing surfaces that are not substantially parallel to the longitudinal axis of the assembly.

In one other aspect of the invention, the front end and/or body of the nose and socket are formed with a generally oval configuration. This construction provides high strength and a longer nose life, omits distinct corners to reduce concentrations of stress, and presents a reduced thickness for enhanced penetration in the ground.

DETAILED DESCRIPTION OF THE PREFERRED EMBODIMENTS

Figure 1:
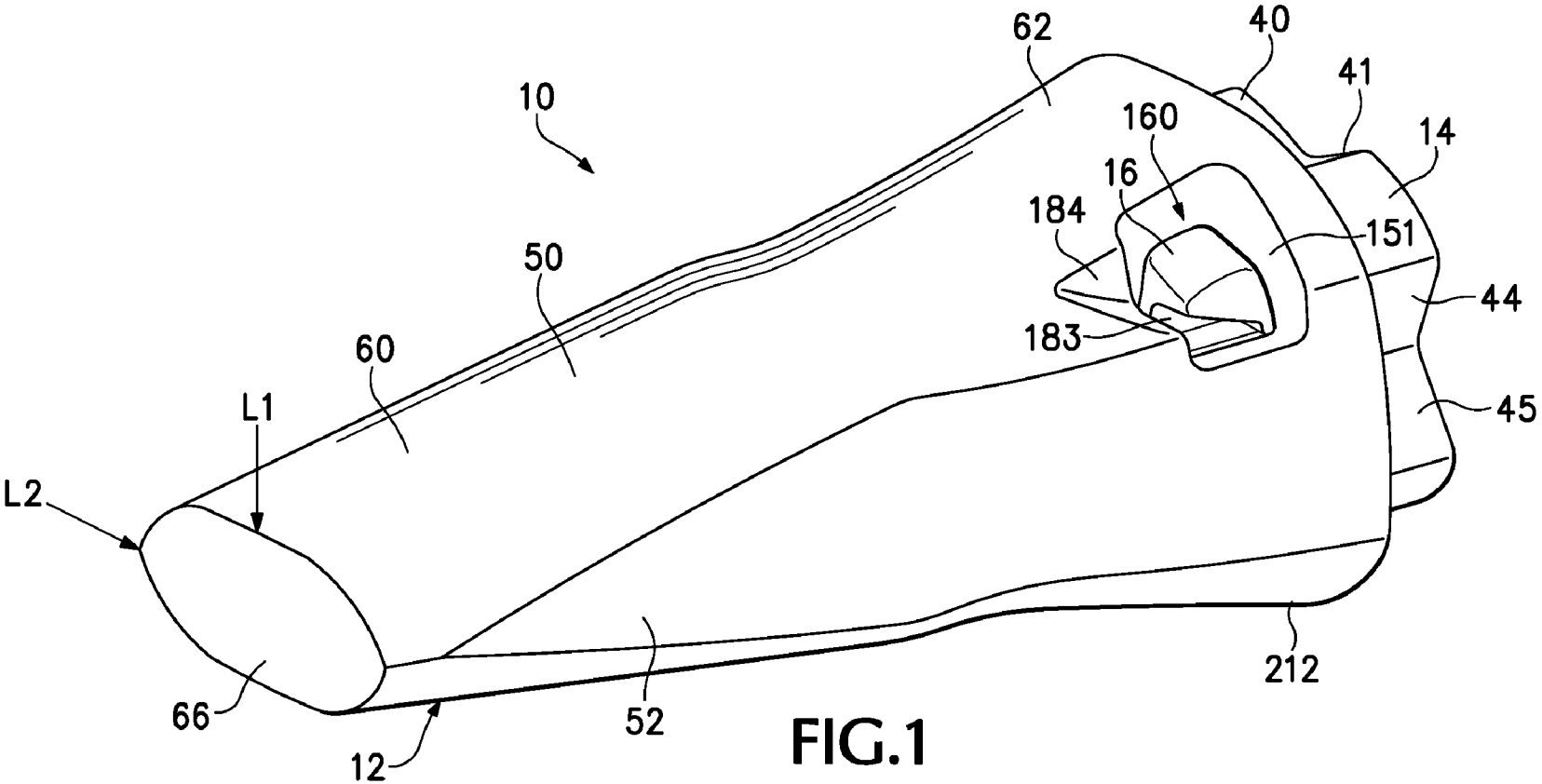
FIGS. 1 and 1A are perspective views of a wear assembly in accordance with the present invention.

The present invention pertains to a wear assembly 10 for releasably attaching a wear member 12 to excavating equipment. In this application, wear member 12 is described in terms of a point for an excavating tooth that is attached to a lip 13 of an excavating bucket. However, the wear member could be in the form of other kinds of products (e.g., shrouds) or attached to other equipment (e.g., dredge cutterheads). Moreover, relative terms such as forward, rearward, up, down, vertical or horizontal are used for convenience of explanation with reference to FIG. 1; other orientations are possible.

In one embodiment (FIGS. 1 and 1A), point 12 is adapted to fit on nose 14 fixed to a bucket lip 13 or other excavating equipment (not shown). In this embodiment, the nose is the front part of a base 15 that is fixed to an excavating bucket. The rear mounting end of the base (not shown in FIG. 1) can be fixed to the bucket lip 13 in a number of ways. For example, the nose can be formed as an integral portion of the lip, such as by being cast with the lip, or otherwise fixed by welding or mechanical attachment. When the base is welded or secured to the lip by a locking mechanism, the base 15 will include one or two rearward legs 17, 18 that extend over the lip 13. In these situations, the base is typically called an adapter. The base can also consist of a plurality of interconnected adapters. The point includes a socket to receive the nose. The point and nose are then secured together by a lock 16.

Nose 14 has a body 25 with top and bottom walls 20, 21 that converge toward a front end 24, and opposite sidewalls 22, 23 (FIGS. 2-6). The rear portion of the sidewalls are generally parallel to each other (i.e., with a slight forward convergence); of course, other configurations are possible. The front end 24 is formed with top and bottom stabilizing surfaces 30, 32 that are substantially parallel to the longitudinal axis 34. The term "substantially parallel" is intended to include parallel surfaces as well as those that diverge rearwardly from axis 34 at a small angle (e.g., of about 1-7 degrees) for manufacturing purposes. In one preferred embodiment, each stabilizing surface 30, 32 diverges rearwardly at an angle to axis 34 of no more than about 5 degrees and most preferably at about 2-3 degrees. In the illustrated embodiment, stabilizing surfaces 30, 32 are laterally curved so as to meet along the sides of the nose. In this way, stabilizing surfaces are formed around the entire front end 24 of the nose 14. Of course, other configurations are possible.

Figure 3:
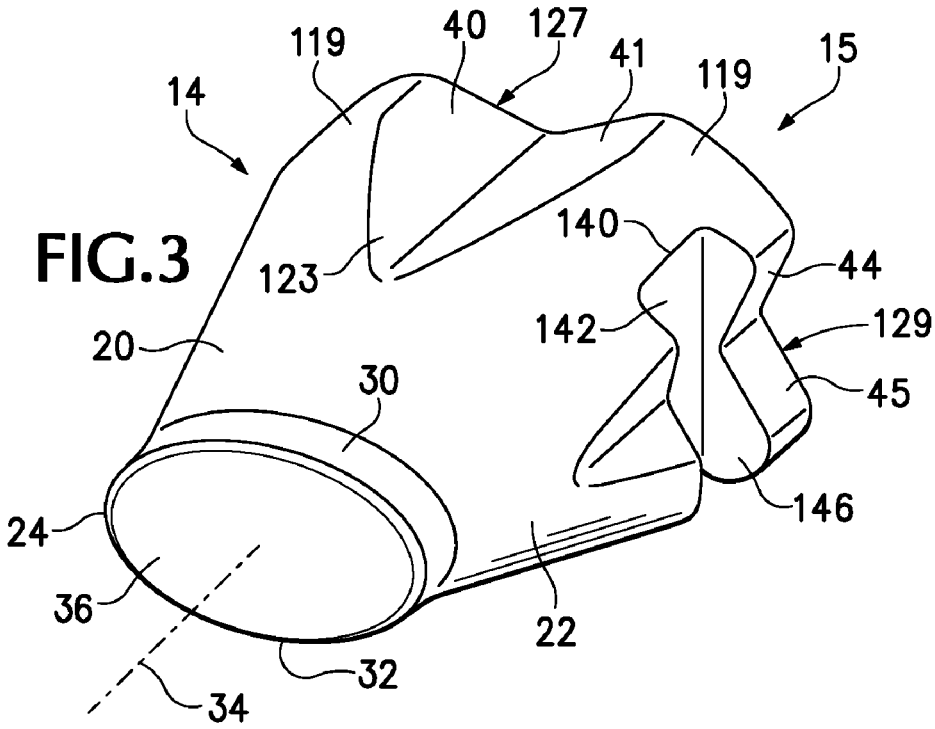
FIG. 3 is a front perspective view of the nose.

In the illustrated embodiment, front end 24 has generally an oval transverse shape with an oval front wall 36. Similarly, the body 25 of nose 14 also has a generally oval transverse shape except for stabilizing recesses 127, 129. As seen in FIG. 3, body 25 expands rearward from front end 24 over much of its length. The use of an oval-shaped nose forms high strength nose sections that result in a longer nose life. An oval shape also lessens the presence of corners and, thus, reduces stress concentrations along the outer edges of the nose. The oval shape also presents a streamlined profile that improves penetration into the ground during a digging operation; i.e., the wear member is formed with an oval-shaped socket for receiving the nose which, in turn, allows the wear member to have a slimmer profile for better penetration. Nevertheless, the front end and body of the nose could have other shapes; for example, the nose and socket could be more angular and define a generally parallelepiped front end with generally rectangular stabilizing surfaces and/or generally flat and angular top, bottom and side walls as the body of the nose. The general configuration of the nose (i.e., the oval shape) can vary considerably.

In one embodiment (FIGS. 2-6), the top, bottom and side walls 20-23 of nose 14 each includes a pair of stabilizing surfaces 40-47 that are each substantially parallel to axis 34. As noted with front stabilizing surfaces 30, 32, these rear stabilizing surfaces 40-47 are preferably angled relative to the longitudinal axis 34 by no more than about 5 degrees, and most preferably at about 2-3 degrees to axis 34. While any portion of the nose may at times bear loads from the point, the stabilizing surfaces are intended to be primary surfaces for resisting loads that are applied to the nose by the point.

Figure 1A:
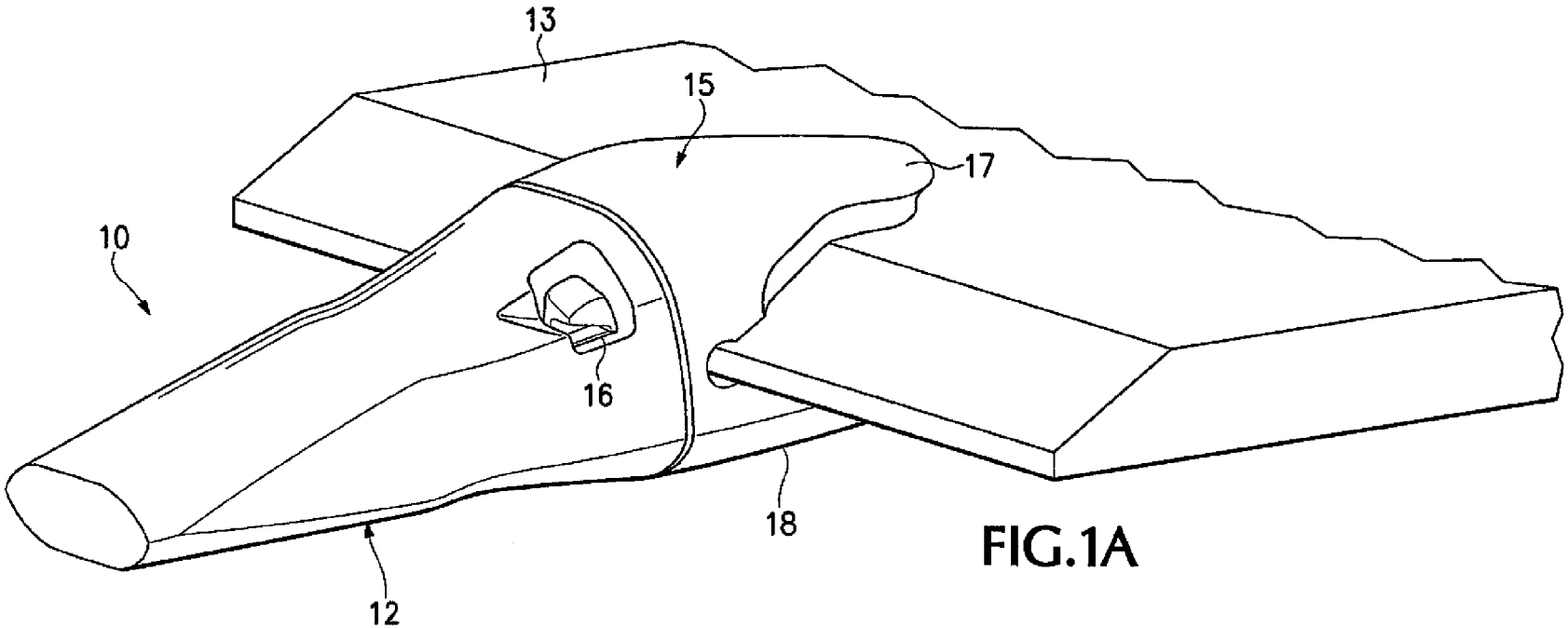
Figure 7:
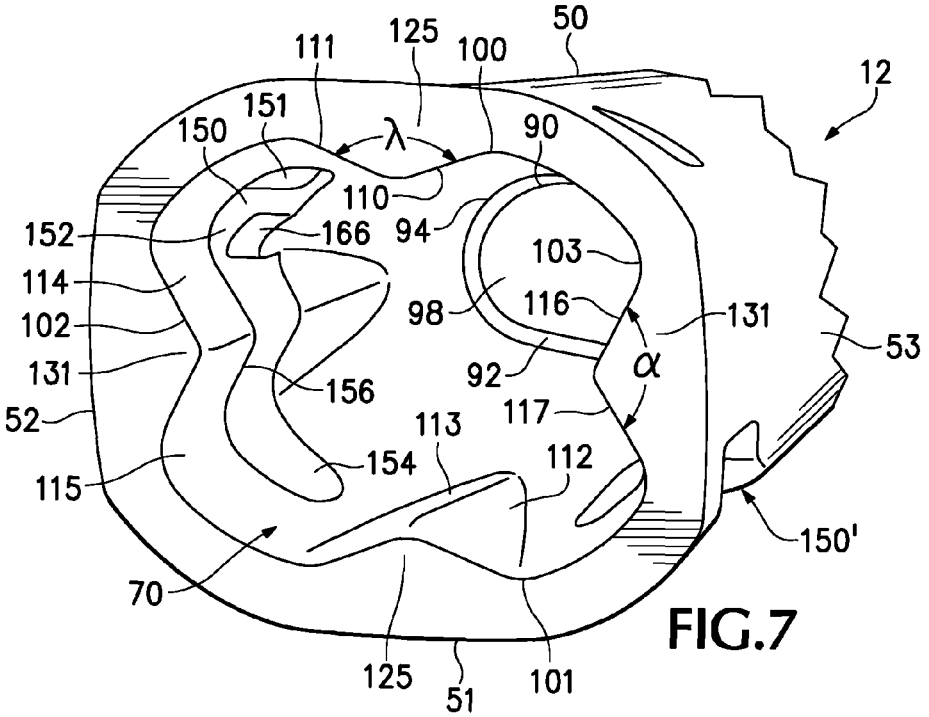
FIG. 7 is a partial, rear perspective view of a wear member of the present wear assembly.
Figure 8:
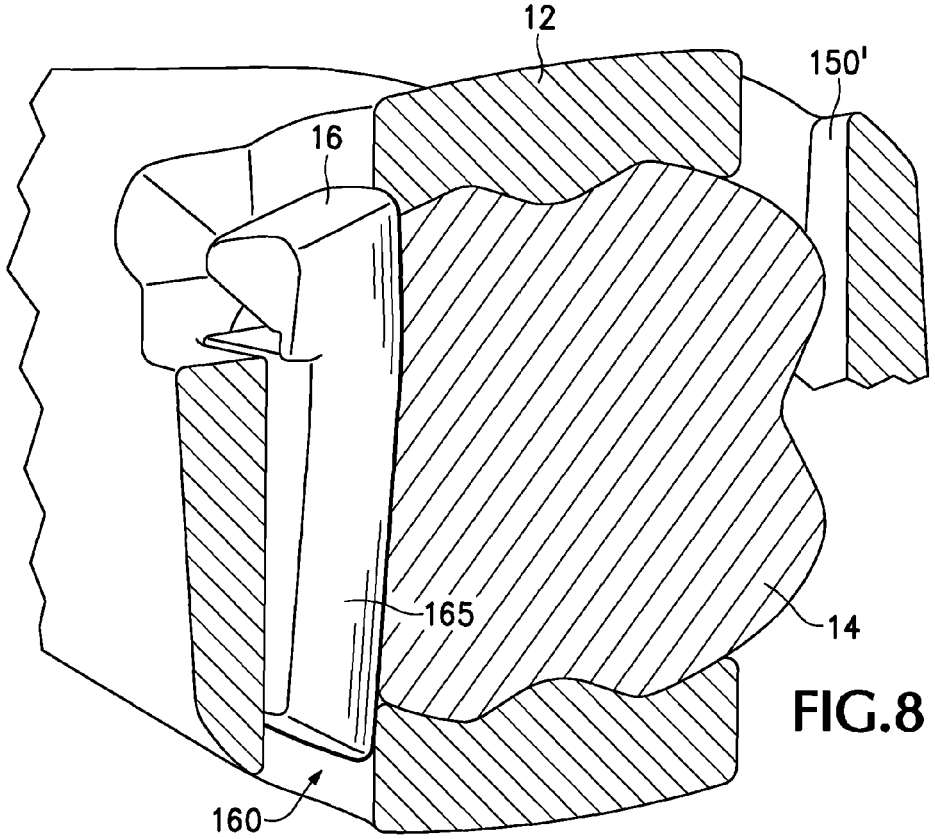
FIG. 8 is a partial perspective view of the wear assembly cut-away along a transverse plane immediately rearward of the lock.

Wear member 12 comprises top, bottom and side portions to define a front working end 60 and a rear mounting end 62 (FIGS. 1, 7 and 8). In regard to a point, the working end is a bit with a front digging edge 66. While the digging edge is shown as a linear segment, the bit and digging edge could have any of the shapes that are used in digging operations. The mounting end 62 is formed with a socket 70 that receives nose 14 for supporting the point on the excavating equipment (not shown). Socket 70 is formed by interior walls of the top, bottom and side portions 50-53 of point 12. Preferably, socket 70 has a shape that is complementary to nose 14, though some variations could be included.

In one embodiment (FIG. 7), socket 70 includes a front end 94 with top and bottom stabilizing surfaces 90, 92 and a generally elliptical front surface 98 to match front end 24 of the nose. Top, bottom and side walls 100-103 of the socket extend rearward from front end 94 to complement top, bottom and side walls 20-23 of nose 14. Each of these walls 100-103 are preferably formed with stabilizing surfaces 110-117 that bear against stabilizing surfaces 40-47 on the nose. As with the stabilizing surfaces 30, 32, 40-47 of the nose, stabilizing surfaces 90, 92, 110-117 in socket 70 are substantially parallel to longitudinal axis 34. Preferably, the stabilizing surfaces in the point are designed to match those in the nose; that is, if the stabilizing surfaces in the nose diverge at an angle of about 2 degrees relative to axis 34, then, the stabilizing surfaces of the socket also diverge at an angle of about 2 degrees to axis 34. However, the stabilizing surfaces 110-117 in socket 70 could be inclined to axis 34 at a slightly smaller angle (e.g., a degree or two) as compared to stabilizing surfaces 40-47 on nose 14 to force a tight engagement between the opposed stabilizing surfaces at a particular location(s), for example, along the rear portions of the nose and socket.

Stabilizing surfaces 40-43 in top and bottom walls 20, 21 are each formed in a central portion of the nose so as to be located in the thickest, most robust portion of the nose. These stabilizing surfaces are preferably limited to the central portions rather than extending entirely across the nose. In this way, the loads are not primarily carried by the outer portions of the nose where the most bending occurs. Moreover, keeping the stabilizing surfaces 40-43 away from the outer edges can also be used to reduce the creation of high stress concentrations in the transition between nose 14 and the mounting portion of base 15. The side portions 119 of nose 14 to each side of stabilizing surfaces 40-43 preferably diverge relative to axis 34 at a steeper angle than stabilizing surfaces 40-43 to provide strength and at times a smoother transition between nose 14 and the rear mounting portion of base 15. Nonetheless, stabilizing surfaces 40-43, 110-113 could extend the entire width and depth of the nose and socket.

Stabilizing surfaces 30, 32, 40-43, 90, 92, 110-113 stably support the point on the nose even under heavy loading. The rear stabilizing surfaces 40-43, 110-113 are preferably tiered (i.e., vertically spaced) relative to front stabilizing surfaces 30, 32, 90, 92 for enhanced operation, but such tiers are not necessary.

When loads having vertical components (herein called vertical loads) are applied along the digging edge 66 of point 12, the point is urged to roll forward off the nose. For example, when a downward load L1 is applied to the top of digging edge 66 (FIG. 1), point 12 is urged to roll forward on nose 14 such that front stabilizing surface 90 in socket 70 bears against stabilizing surface 30 at front end 24 of nose 14. The bottom, rear portion 121 of point 12 is also drawn upward against the bottom rear portion of nose 14 such that rear stabilizing surfaces 112, 113 in the socket bear against stabilizing surfaces 42, 43 on the nose. The substantially parallel stabilizing surfaces provide a more stable support for the point as compared to converging surfaces, with less reliance on the lock. For instance, if load L1 was applied to a nose and socket defined by converging top and bottom walls without stabilizing surfaces 42, 43, 112, 113, the urge to roll the point on the nose is resisted in part by the abutting of rear portions of the bottom converging walls. Since these walls are inclined, their abutment tends to urge the point in a forward direction, which must be resisted by the lock. Accordingly, in such constructions, a larger lock is needed to hold the point to the nose. A larger lock, in turn, requires larger openings in the nose and point, thus, reducing the overall strength of the assembly. In the present invention, stabilizing surfaces 30, 42, 43, 90, 112, 113 are substantially parallel to longitudinal axis 34 to lessen this forward urging of the point. As a result, the point is stably supported on the nose, which increases the strength and stability of the mount, reduces wear, and enables the use of smaller locks. Stabilizing surfaces 32, 40, 41, 92, 110, 111 function in the same manner for upwardly-directed vertical loads.

Figure 2:
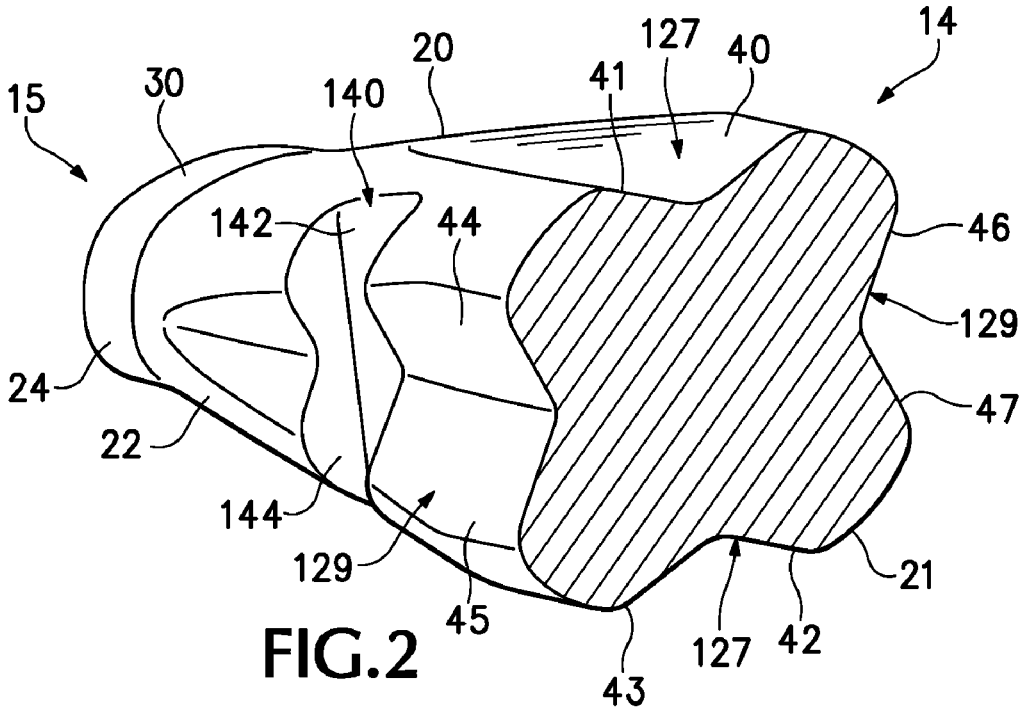
FIG. 2 is a rear perspective view of a nose of the present wear assembly.
Figure 4:
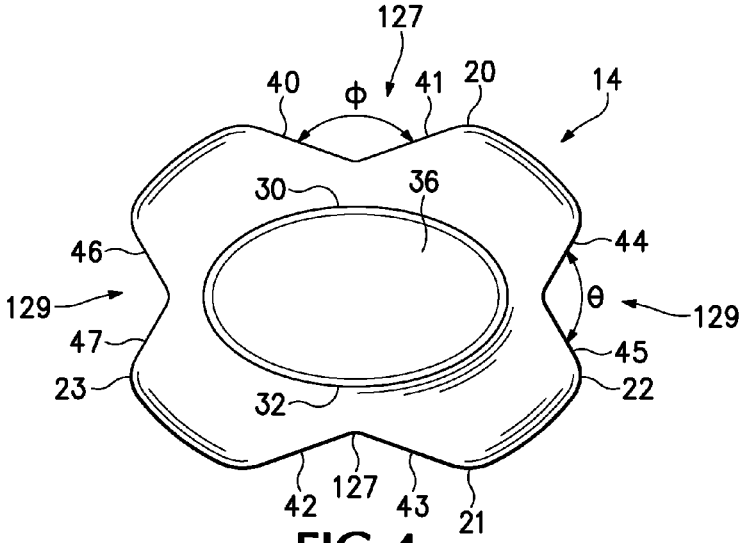
FIG. 4 is a front view of the nose.
Figure 5:
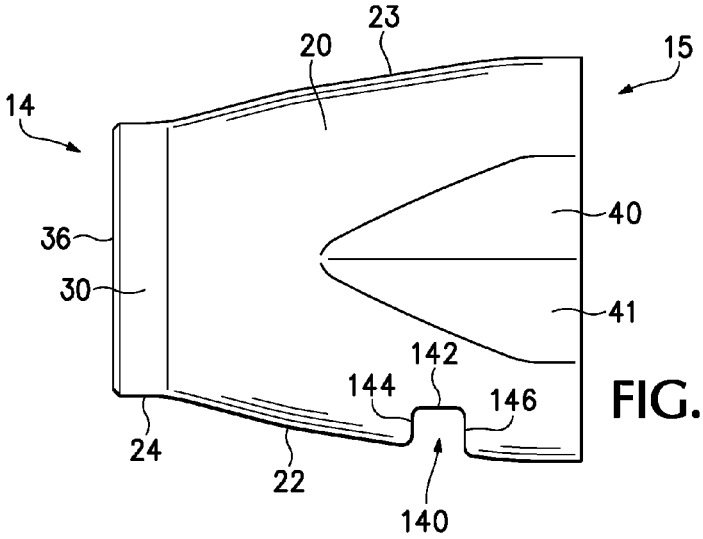
FIG. 5 is a top view of the nose.
Figure 6:
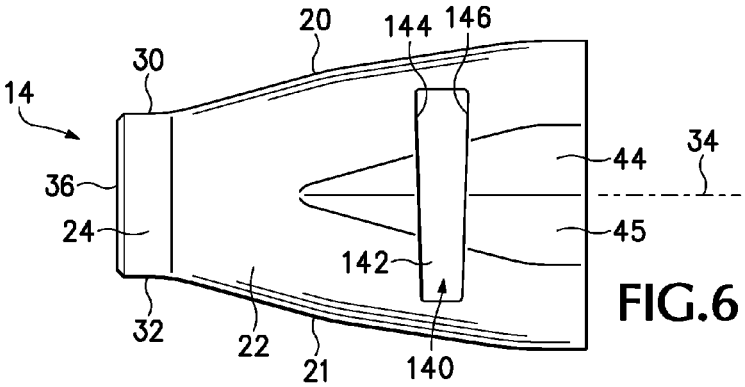
FIG. 6 is a side view of the nose.

In the illustrated embodiment (FIGS. 2-6), stabilizing surfaces 40, 41 on top wall 20 are inclined to each other in a transverse direction (FIGS. 2-4). In the same way, stabilizing surfaces 42, 43 are set at a transverse angle to each other. Preferably, angled stabilizing surfaces 40-43 are symmetrical. Likewise, stabilizing surfaces 110-113 form inclined surfaces to bear against stabilizing surfaces 40-43 of nose 14. This transverse inclination enables stabilizing surfaces 40-43 to engage stabilizing surfaces 110-113 in socket 70 and resist loads with side or lateral components (herein called side loads), such as load L2 (FIG. 1). It is advantageous for the same surfaces resisting vertical loading to also resist side loading because loads are commonly applied to points in shifting directions as the bucket or other excavating equipment is forced through the ground. With the laterally inclined surfaces, bearing between the same surfaces can continue to occur even if a load shifts, for example, from more of a vertical load to more of a side load. With this arrangement, movement of the point and wearing of the components can be reduced.

The stabilizing surfaces 40-41 and 42-43 are preferably oriented relative to each other at an angle $\phi$ between about 90° and 180°, and most preferably at about 160 degrees (FIG. 4). The angle is generally chosen based on a consideration of the expected loads and operation of the machine. As a general rule, though there could be exceptions, angle $\phi$ would preferably be large when heavy vertical loads are expected and smaller when heavier side loading is expected. Since heavy vertical loading is common, the angle between the stabilizing surfaces will generally be a large one. However, this transverse angle $\phi$ may vary considerably and be smaller than 90° in certain circumstances, such as in light duty operations or those with exceptionally high side loading.

As seen in FIGS. 2 and 3, rear stabilizing surfaces 40-41 and 42-43 are preferably planar and oriented to form V-shaped recesses 127 in the nose. However, these rear stabilizing surfaces could have a myriad of different shapes and orientations. While the objectives of the invention may not be fully met in each different shape, the variations are still able to achieve certain aspects of the invention. For example, the rear stabilizing surfaces need not be planar and could be formed with convex or concave curves. The rear stabilizing surfaces could be formed to define a shallow U-shaped continuous curve so that the inclined stabilizing surfaces flow uninterrupted into each other. The rear stabilizing surfaces could form a generally trapezoidal recess having a central stabilizing surface with generally no transverse inclination and two side stabilizing surfaces at virtually any obtuse angle to the central surface to resist side loading. The rear stabilizing surfaces could be inclined to each other at varying angles. The formation of stabilizing recesses in the nose and complementary projections in the socket is preferred to reduce the risk of wearing or deforming the nose surfaces by the mounting of multiple points or on account of holes being worn through the point. Nevertheless, the recesses and projections could be reversed. Also, since vertical loading is often much more significant than side loading, the stabilizing surfaces could be centrally positioned on the nose in spaced relation to the side edges but with no transverse inclination.

The rear stabilizing surfaces 40-43 are generally most effective when located at or near the rear end of the nose. Hence, in the illustrated embodiment (FIGS. 2-6), front portions 123 of stabilizing surfaces 40-43 taper to a front point. Of course, front portions 123 could have other narrowing shapes, non-converging shapes, or be eliminated entirely. Although stabilizing surfaces 40-41 are preferably the mirror images of stabilizing surfaces 42-43, it is not required that they be so.

In each of these orientations, the stabilizing surfaces 110-113 of the point preferably complement the stabilizing surfaces on the nose, however, variations could be used. Accordingly, as illustrated, stabilizing surfaces 110, 111 complement stabilizing surfaces 40, 41, and stabilizing surfaces 112, 113 complement stabilizing surfaces 42, 43. Hence, in the illustrated embodiment, stabilizing surfaces 110, 111 in the top wall 100 of socket 70 are formed to define a generally V-shaped stabilizing projection 125 with the stabilizing surfaces inclined to each other at an angle $\lambda$ of about 160 degrees to fit into stabilizing recess 127 formed by stabilizing surfaces 40, 41 on nose 14 (FIG. 7). Likewise, stabilizing surfaces 112, 113 in bottom surface 101 of socket 70 form a V-shaped stabilizing projection 125 to matingly fit within the stabilizing recess 127 formed by stabilizing surfaces 42, 43 on the nose. Nevertheless, the lateral angle $\lambda$ between each of pair of stabilizing surfaces (such as between surfaces 110 and 111) in socket 70 could be slightly varied relative to the angle $\phi$ between each pair of the corresponding stabilizing surfaces on the nose (such as between surfaces 40 and 41) to ensure a tight fit at a certain location (e.g., along the center of the stabilizing recesses 127, 129).

Figure 10:
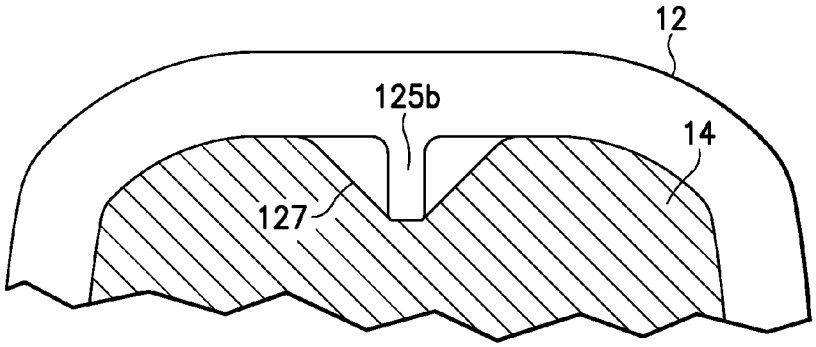
Figure 11:
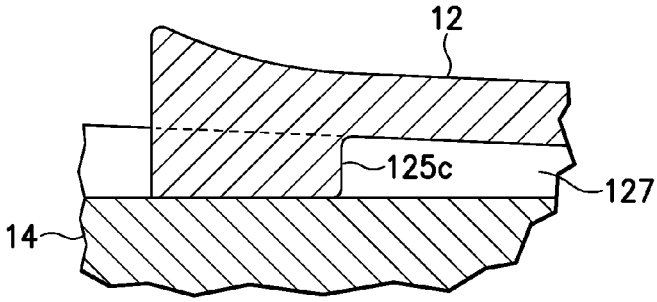
Figure 12:
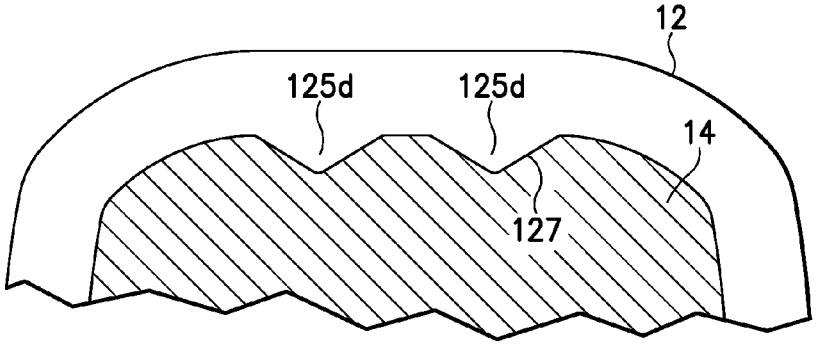

As alternatives, the stabilizing projections of socket 70 could have other shapes or forms to fit within stabilizing recesses 127. For example, the stabilizing projections 125*a* could have a curved (e.g., hemispherical) configuration (FIG. 9) to fit within the V-shaped stabilizing recess 127, a complementary curved recess or other recess shape adapted to receive the projection. Also, the stabilizing projections 125*b* (FIG. 10) could be thinner than the stabilizing recess 127 into which it is received. Stabilizing projections may have a shorter length than the recesses 127 and extend only partially along the length of the recess (FIG. 11) or have an interrupted length with gaps in between segments. Stabilizing projections may also be provided by a separate component such as a spacer that is held in place by a bolt, the lock, or other means. Further a plurality of stabilizing projections 125*d* (FIG. 12) may be provided in place of a single central projection. Also, in certain circumstances, e.g., in light duty operations, a limited benefit can be achieved through the use of, for example, recesses and projections in the top and bottom walls of the nose and socket that are defined by bearing surfaces that are not substantially parallel to longitudinal axis 34, in lieu of stabilizing surfaces 40-43, 110-113.

Sidewalls 22, 23 of nose 14 are also preferably formed with stabilizing surfaces 44-47 (FIGS. 2-6). These stabilizing surfaces 44-47 are also substantially parallel to longitudinal axis 34. In the illustrated embodiment, stabilizing surfaces 44, 45 are oriented at an angle $\theta$ to each other so as to define a longitudinal recess or groove 129 along sidewall 22 of nose 14 (FIG. 4). Likewise, stabilizing surfaces 46, 47 are oriented at an angle θ to each other to define a recess or groove 129 along sidewall 23 as well. These stabilizing surfaces 44, 45 and 46, 47 are preferably set at an angle θ between about 90° and 180°, and most preferably at about 120 degrees. Nonetheless, other angles could be selected including those substantially smaller than 90° and even to a parallel relationship in certain circumstances, such as heavy vertical loading or light duty operations. Stabilizing recesses 129 along sidewalls 22, 23 are adapted to receive complementary stabilizing projections 131 formed in socket 70. Stabilizing projections 131 are defined by stabilizing surfaces 114-117 forming inclined surfaces to bear against stabilizing surfaces 44-47 of nose 14 (FIG. 7). The lateral angle α between side stabilizing surfaces 114, 115 and 116, 117 preferably matches the angle θ of surfaces 44, 45 and 46, 47. Nevertheless as discussed for rear stabilizing surfaces 110-113, the angle between each pair of side stabilizing surfaces in socket 70 could be varied slightly from the side stabilizing surfaces on nose 14 to form a tight fit at a particular location (e.g., along the center of the stabilizing recesses 129). Also, the variations in shapes for stabilizing recesses 127 and stabilizing projections 125 discussed above are equally applicable for recesses 129 and projections 131.

Front stabilizing surfaces 30, 32 work in conjunction with side stabilizing surfaces 44-47 to resist side loads such as L2. For example, the application of side load L2 causes point 12 to cant on nose 14. The side portions of front stabilizing surfaces 90, 92 on the side load L2 is applied are pushed laterally inward to bear against front stabilizing surfaces 30, 32 on the nose. The rear portion of the opposite sidewall 52 of point 12 is drawn inward such that stabilizing surfaces 114, 115 bear against 44, 45. Stabilizing surfaces 30, 32, 46, 47, 90, 92, 116, 117 function in the same way for oppositely directed side loads.

The angled orientation of stabilizing surfaces 44-47 enable these side stabilizing surfaces to bear against stabilizing surfaces 114-117 in socket 70 to resist side and vertical loading. In the preferred construction, rear stabilizing surfaces 40-43, 110-113 are oriented closer to horizontal than vertical to primarily resist vertical loads and secondarily resist side loads. Side stabilizing surfaces 44-47, 114-117 are oriented closer to vertical than horizontal to primarily resist side loading and secondarily resist vertical loading. However, alternative orientations are possible. For example, in heavy loading conditions, all the stabilizing surfaces 40-47, 110-117 may be more horizontal than vertical. In use, then, in the preferred construction, vertical and side loads are each resisted by front stabilizing surfaces 30, 32, 90, 92, rear stabilizing surfaces 40-43, 110-113, and side stabilizing surfaces 44-47, 114-117. The provision of stabilizing surfaces on each of the top, bottom and side walls of the nose and socket maximizes the area the stabilizing surfaces that can be used to support the point.

Preferably, stabilizing surfaces 44-47 are angled equally relative to a horizontal plane extending through axis 34. Nevertheless, asymmetric arrangements are possible, particularly if higher upward vertical loads are expected as compared to downward vertical loads or vice versa. As discussed above for rear stabilizing surfaces 40-43, side stabilizing surfaces 44-47 can be formed with a variety of different shapes. For example, while surfaces 44-47 are preferably planar, they can be convex, concave, curved or consisting of angular segments. Grooves 129 could also be formed with generally U-shaped or trapezoidal cross sections. Also, stabilizing recesses 129 could be formed in the side walls 102, 103 of socket 70 and stabilizing projections 131 in sidewalls 22, 23 of nose 14.

In the preferred wear assembly, stabilizing surfaces 40-47 define a stabilizing recess 127, 129 in each of the top, bottom and side walls 20-23 of nose 14 such that those portions of the nose with the recesses have a generally X-shaped cross-sectional configuration (FIGS. 2 and 8). Socket 70 has complementary stabilizing projections 125, 131 along each of the top, bottom and side walls 100-103 to fit into recesses 127, 129 and, thus, define an X-shaped socket. While generally V-shaped recesses 127, 129 are preferred, stabilizing recesses and projections of other shapes can be used to form the generally X-shaped nose and socket. This configuration stably mounts the point against vertical and side loading, supports high loading via the strongest and most robust portions of the nose, and avoids relying primarily on side portions of the nose where bending is greatest to reduce stress concentrations. The X-shaped cross-sectional nose and socket can also be used with limited benefit in certain applications with similar recesses in each of the top, bottom and side walls 20-23 but without the use of stabilizing surfaces extending substantially parallel to axis 34.

The nose can also be formed with configurations other than an X-shaped cross-section. For example, the nose and point may include top and bottom stabilizing surfaces 40-43, 110-113, but no side stabilizing surfaces 44-47, 114-117. In another alternative, the nose may be formed with side stabilizing surfaces 44-47, 114-117, but without stabilizing recesses 127 in the top and bottom walls. The nose and point may also be provided with only one set of stabilizing surfaces, such as rear stabilizing surfaces only along the bottom walls. Also, while front stabilizing surfaces 30, 32, 90, 92 could be omitted, it is preferred that they be used with whichever variation of rear and side stabilizing surfaces that are used.

As noted above, lock 16 is used to releasably secure wear member 12 to nose 14 (FIGS. 1 and 8). In one embodiment, nose 14 defines a channel 140 in sidewall 22 (FIGS. 2-6). Channel 140 is open on its outer side and on each end, and otherwise is defined by a base or side wall 142, a front wall 144 and a rear wall 146. Wear member 12 includes a complementary passage 150 to generally align with channel 140 when point 12 is assembled onto nose 14 to collectively define an opening 160 for receiving lock 16 (FIGS. 1 and 7-8). Passage 150 includes an open end 151 in top wall 50 of point 12 for receiving lock 16. Within socket 70, passage 150 is open on its inner side and otherwise defined by a base or side wall 152, a front wall 154, and a rear wall 156. Due to side stabilizing surfaces 44-47, 114-117, the front and rear walls 144, 146, 154, 156 of channel 140 and passage 150 have complementary undulating configurations. Front wall 144 on nose 14 and rear wall 156 on wear member 12 are the surfaces that primarily engage lock 16. Passage 150 is preferably open in bottom wall 51, but it could be closed if desired.

Although point 12 is secured by only one lock 16, the point preferably includes two passages 150, 150', one along each sidewall 52, 53. Passages 150, 150' are identical except that passage 150 opens for receipt of lock 16 in top wall 50 and extends along sidewall 52, and passage 150' opens for receipt of lock 16 in bottom wall 51 and extends along sidewall 53. With two passages, the point can be reversed (i.e., rotated 180° about axis 34) and locked in place in either orientation.

When lock 16 is inserted into hole 160, it opposes front wall 144 of nose 14 and rear wall 156 of point 12 to prevent release of point 12 from nose 14. Accordingly, in an assembled condition, channel 140 is offset rearward of passage 150 so that front wall 144 is rearward of front wall 154, and rear wall 146 is rearward of rear wall 156. In the preferred construction, hole 160 narrows at it extends from open end 151; that is, front wall 144 converges toward rear wall 156, and side wall 142 converges toward side wall 152, each as they extend away from open end 151. Preferably, channel 140 and passage 150 also converge as they extend from open end 151 so that front wall 144 converges toward rear wall 146, and front wall 154 converges toward rear wall 156.

Lock 16 has a tapering construction with a latch such as disclosed in U.S. Pat. No. 6,993,861, incorporated herein by reference. In general, lock 16 includes a body 165 for holding point 12 to nose 14, and a latch (not shown) for engaging stop 166 in point 12 for securing lock 16 in hole 160. Body 165 includes an insertion end 169 that is first passed into hole 160, and a trailing end 171. Lock body 165 preferably tapers toward insertion end 169 with the front and rear walls converging toward each other, and sidewalls converging toward each other. This narrowing of lock 16 matches the shape of hole 160 to provide a lock that can be pried into and out of the assembly. A gap 183 is formed near trailing end 171 for insertion of a pry tool for removing lock 16 from opening 160. A clearance space 184 is also formed in point 12 forward of open end 151 to enable a pry tool to access gap 183.

Figure 9:
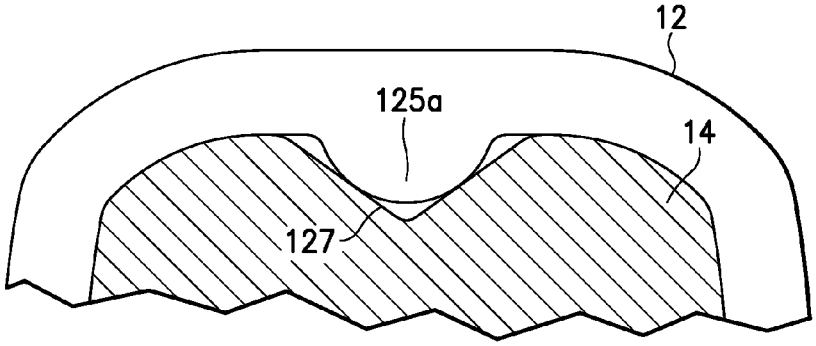
FIGS. 9-12 are transverse cross sections along the top wall of the wear member illustrating different examples of stabilizing projections.
Figure 13:
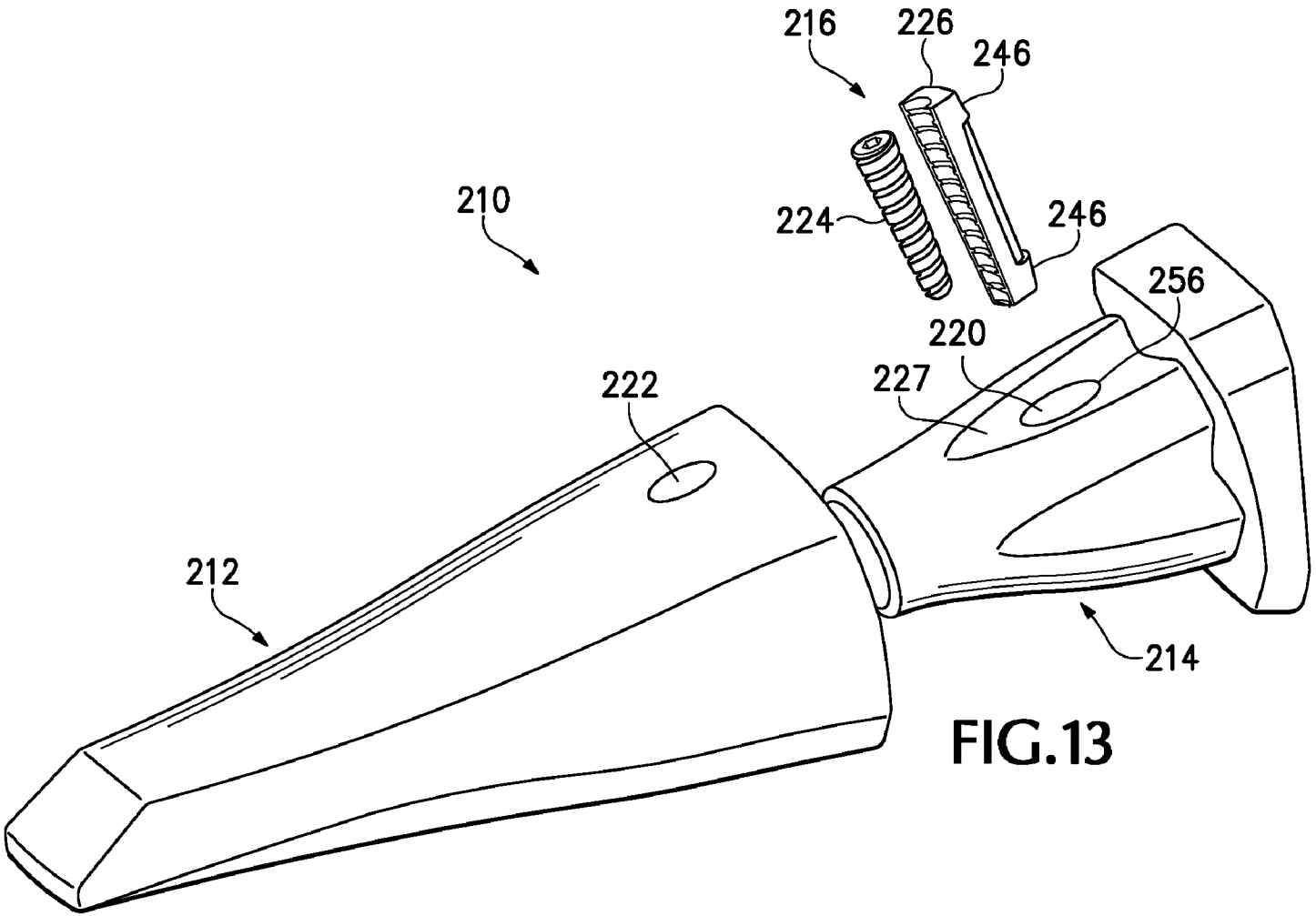
FIG. 13 is a perspective view of a wear assembly of the present invention with an alternative locking arrangement.
Figure 14:
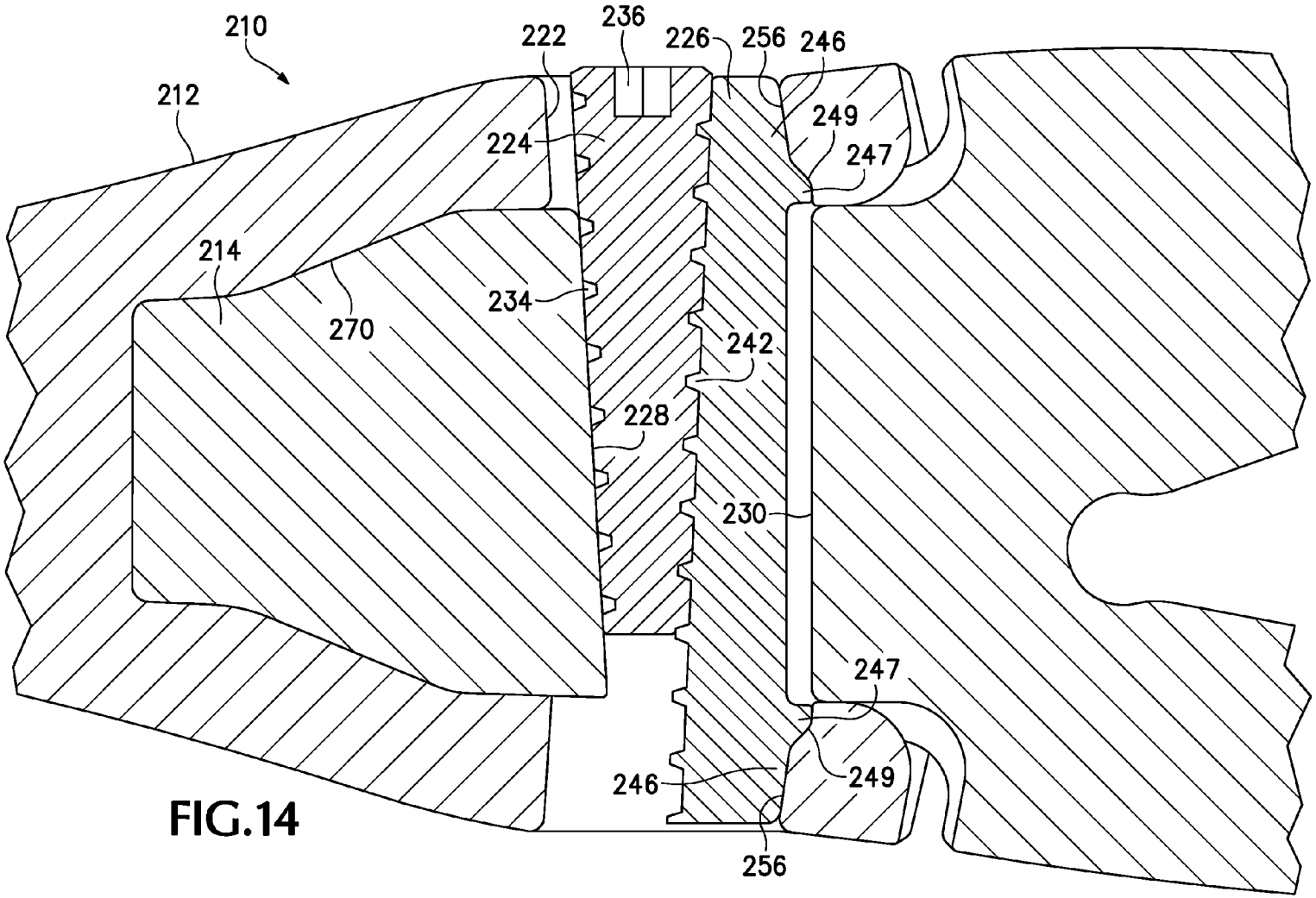
FIG. 14 is a partial, axial cross-sectional view of the alternative wear assembly.
Figure 15:
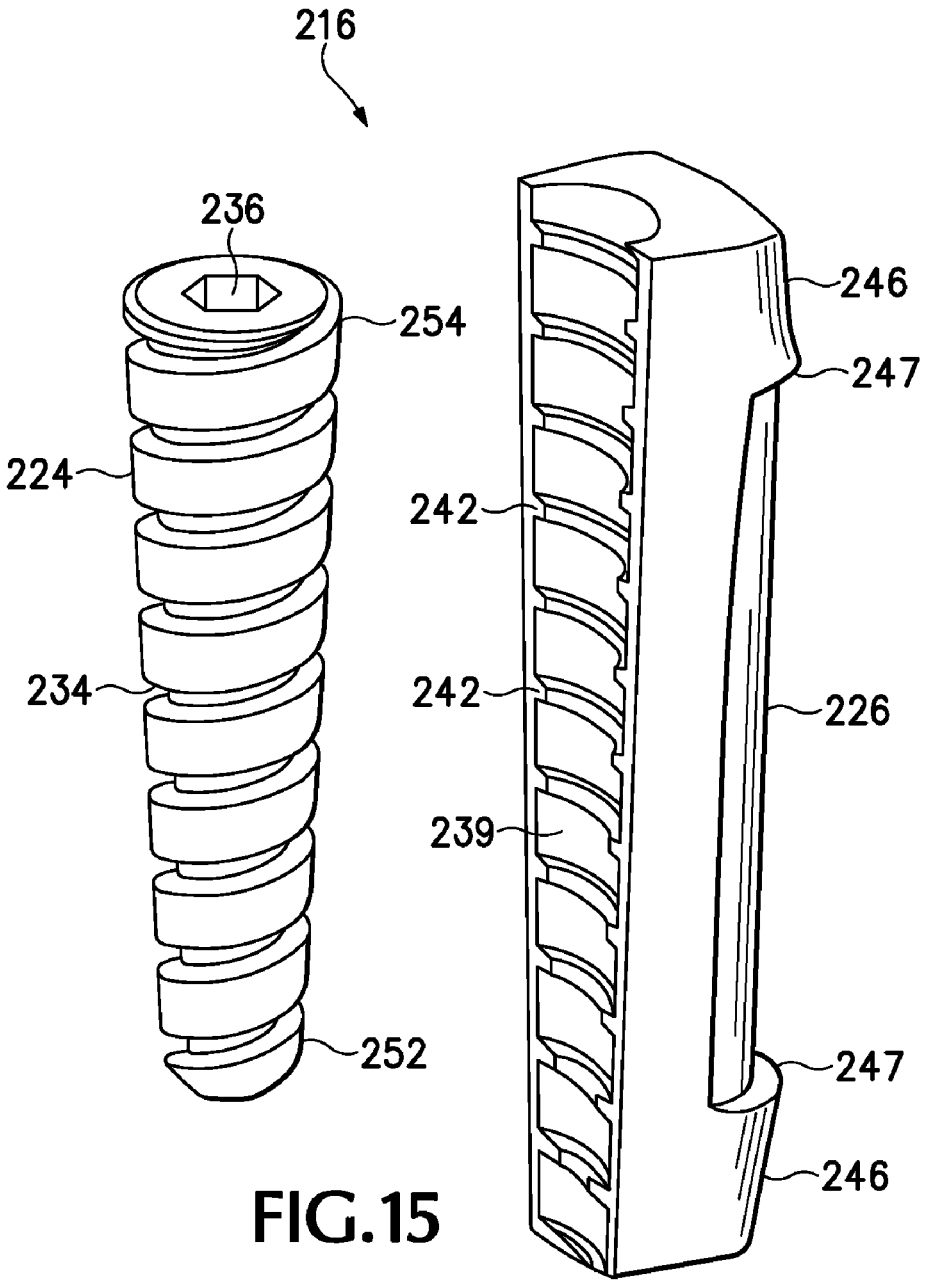
FIG. 15 is an exploded perspective view of the lock of the alternative wear assembly.

In a second embodiment of the invention (FIGS. 13-15), a wear assembly 210 includes a base having a nose 214 and a wear member 212 having a socket 270 for receiving the nose 214. The nose and socket of wear assembly 210 is the same as wear assembly 10 except for the locking arrangement. In wear assembly 210, lock 216 is received in a central passage 220 in nose 214 and corresponding holes 222 in wear member 212. As seen in FIG. 9, passage 220 opens in stabilizing recess 227. A hole 222 is formed in each of the top and bottom portions of wear member 212, in vertical alignment, to engage the lock and/or permit the wear member to be reversed on nose 214. Alternatively, passage 220 and holes 222 could extend horizontally through the nose 214 and wear member 212.

Lock 216 includes a wedge 224 and a spool 226 as described in U.S. Pat. No. 7,171,771, incorporated herein by reference. The wedge 224 has a rounded narrowing exterior, a helical thread 234, and a tool engaging cavity 236. The spool 226 is formed with arms 246 that set outside passage 220. Each arm preferably includes an outstanding lip 247 at its outer end that fits under a relief 249 in point 212 to project ejection of the lock during use. Spool 226 includes a thread formation 242 preferably in the form a series of helical ridge segments to mate with the helical thread 234 on wedge 224. Spool 226 has a trough 239 with a concave inner surface 240 to partially wrap around and receive wedge 224. A resilient plug (not shown) composed of a rubber, foam or other resilient material may be provided in a hole in trough 239 to press against wedge 224 and prevent loosening if desired. The spool preferably tapers toward its lower end to accommodate the preferred tapering of passage 220. The spool may also be formed with a reduced leading end to better fit through the bottom end of passage 220 and into lower hole 222.

In use, spool 226 presses against front wall 228 of passage 220, and the ends of arms 246 press against the rear walls 256 in the top and bottom portions of wear member 212. A gap normally exists between spool 226 and rear wall 230 of passage 220. The land 258 extending between helical groove 234 of wedge 224 sets against the front wall 228 of passage 220. An insert (not shown) may be placed between the wedge and front wall 228. Alternatively, the spool could be placed against front wall 228 and wedge against rear walls 256. To install lock 216, the spool 226 and the leading end 252 of wedge 224 are loosely inserted through top hole 222 and into passage 220. A wrench or other suitable tool is inserted into cavity 236 at the trailing end 254 of wedge 224 to turn the wedge and draw the wedge farther into the passage 220.

Many other lock designs could be used to secure the wear member to the nose. For example, lock 16 may be a conventional sandwich pin construction, which is hammered into the assembly. Such a lock could also pass through holes in the centers of the nose and point, either vertically or horizontally, in a well-known manner.

The invention claimed is:

1. A wear assembly for excavating equipment comprising:

a base fixed to the excavating equipment and having a supporting nose and a bearing surface;

a wear member including a front end to contact materials to be excavated by the excavating equipment, a rear end, a socket opening in the rear end for receiving the supporting nose of the base, and an opening, the socket being defined by a top wall, a bottom wall and side walls and including a longitudinal axis, at least one of the top and bottom walls including a pair of centrally located stabilizing surfaces inclined relative to each other in different transverse directions so as to laterally converge toward a central location along the respective top or bottom wall and positioned to bear against complementary surfaces on the nose to resist both vertical and horizontal loads during excavating, each said side wall including a pair of side stabilizing surfaces inclined relative to each other in different transverse directions so as to laterally converge toward a central location along the respective side wall and be positioned to bear against complementary surfaces on the nose to resist both vertical and horizontal loads during excavating, and each said stabilizing surface and each said side stabilizing surface axially extending substantially parallel to the longitudinal axis; and a lock received into the opening of the wear member and in contact with the bearing surface of the base to hold the wear member to the excavating equipment.

2. A wear assembly in accordance with claim 1 wherein the top and bottom walls of the wear member each includes a pair of said stabilizing surfaces to bear against the complementary surfaces on the base.

3. A wear assembly in accordance with claim 1 wherein each said pair of stabilizing surfaces and said pair of side stabilizing surfaces of the wear member collectively defines a V-shaped formation.

4. A wear assembly in accordance with claim 1 wherein each said pair of stabilizing surfaces and said pair of side stabilizing surfaces of the wear member collectively defines a curved formation.

5. A wear assembly in accordance with claim 1 wherein each said pair of stabilizing surfaces and said pair of side stabilizing surfaces of the wear member defines a projection that fits within a recess defined in the nose.

6. A wear assembly in accordance with claim 1 wherein the stabilizing surfaces and the side stabilizing surfaces of the wear member are located near the rear end of the wear member.

7. A wear member for excavating equipment comprising a front end to contact materials to be excavated by the excavating equipment, a rear end, a socket opening in the rear end for receiving a supporting nose fixed to the excavating equipment, and an opening for receiving a lock to releasably hold the wear member to the nose, the socket being defined by a top wall, a bottom wall and side walls and including a longitudinal axis, at least one of the top and bottom walls including a pair of centrally located stabilizing surfaces inclined relative to each other in different transverse directions so as to laterally converge toward a central location along the respective top or bottom wall and be positioned to bear against complementary surfaces on the nose to resist both vertical and horizontal loads during excavating, each said side wall including a pair of side stabilizing surfaces inclined relative to each other in different transverse directions so as to laterally converge toward a central location along the respective side wall and be positioned to bear against complementary surfaces on the nose to resist both vertical and horizontal loads during excavating, and each said stabilizing surface and said side stabilizing surface axially extending substantially parallel to the longitudinal axis.

8. A wear member in accordance with claim 7 wherein the top and bottom walls each includes a pair of said stabilizing surfaces.

9. A wear member in accordance with claim 7 wherein each said pair of stabilizing surfaces and said pair of side stabilizing surfaces collectively defines a V-shaped formation.

10. A wear member in accordance with claim 7 wherein each said pair of stabilizing surfaces and said pair of side stabilizing surfaces collectively defines a curved formation.

11. A wear member in accordance with claim 7 wherein each said pair of stabilizing surfaces extends from one side wall to the other side wall.

12. A wear member in accordance with claim 7 wherein each said pair of stabilizing surfaces and said pair of side stabilizing surfaces defines a projection that fits within a recess defined in the nose.

13. A wear member in accordance with claim 7 wherein the stabilizing surfaces and the side stabilizing surfaces are located near the rear end.

* * * * *